United States Patent [19]

Magee

[11] 4,026,389

[45] May 31, 1977

[54] ELEVATOR CAR PASSENGER SECURITY SYSTEM

[76] Inventor: John E. Magee, 191 Forest Blvd., Ardsley, N.Y. 10502

[22] Filed: Dec. 11, 1975

[21] Appl. No.: 639,850

[52] U.S. Cl. ..... 187/29 R
[51] Int. Cl.[2] ..... B66B 1/16
[58] Field of Search ..... 187/29

[56] References Cited

UNITED STATES PATENTS

| | | | |
|---|---|---|---|
| 3,314,501 | 4/1967 | Magee | 187/29 |
| 3,388,376 | 6/1968 | Magee | 187/29 |
| 3,428,148 | 2/1969 | Jacobs | 187/29 |
| 3,450,231 | 6/1969 | Kuzara | 187/29 |
| 3,511,344 | 5/1970 | De Lamater | 187/29 |

*Primary Examiner*—Robert K. Schaefer
*Assistant Examiner*—W. E. Duncanson, Jr.
*Attorney, Agent, or Firm*—Brooks Haidt Haffner & Delahunty

[57] ABSTRACT

An elevator control modifying system which detects the existence of a call registered by a passenger in an elevator car and, until delivery of the registering passenger to the call destination, automatically prevents stopping of the elevator for calls registered at intervening landings and to which the car would normally respond. Upon delivery of the car passenger at the designated floor, the control is automatically conditioned to respond to calls registered at landings. Optionally, high call reversal, if present, is restricted to effective car calls when such a call is registered by the car passenger.

4 Claims, 2 Drawing Figures

ELEVATOR CAR PASSENGER SECURITY SYSTEM

Figure 1:
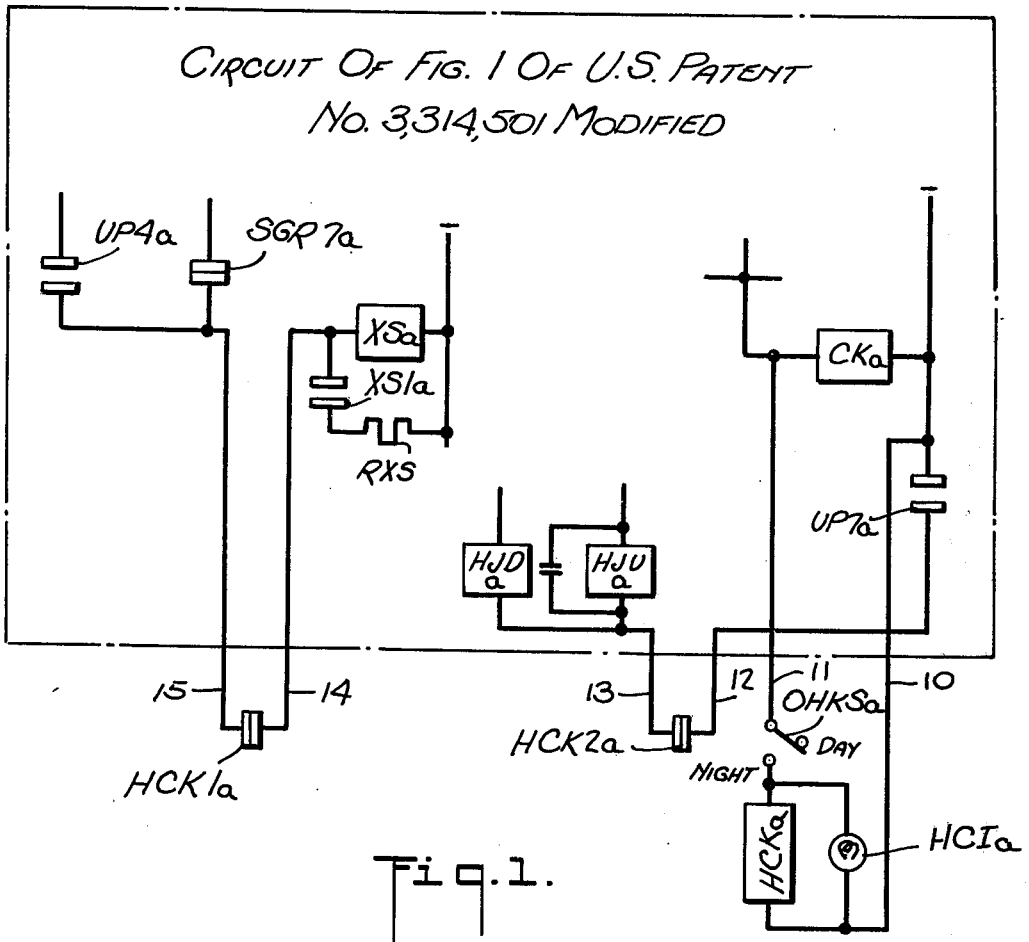

This invention relates to an elevator control system modification for insuring delivery of an elevator car passenger to his registered destination without stopping of the car at calls registered by intending passengers at intervening landings, which, in the normal unmodified operation of the control system, would stop the car at such landings.

It is common practice for an elevator car to stop, receive passengers at and cancel any calls registered by passengers at landings (landing calls) which are for its direction of travel and which are between the pickup and destination landings of a car passenger. This applies both to "collective" elevators, widely furnished for apartment service, and to elevators in high-rise groups in commerical structures. It is also common practice in attended elevators to provide a non-stop operation which permits the attendant, by holding a special "by-pass" button pressed, to prevent stop initiation for landing calls, within the attendant's discretion. It is further known in sophisticated elevator group control systems to by-pass landing calls automatically in order to expedite arrival of the elevator at a special status landing call or at a dispatch terminal. In addition, it is known in the art to provide express service from certain floors to other floors and to provide special service, such as in a hospital or in an emergency, which causes the car to act only under control of the car buttons. However, it is usual in all these cases, either for the floors receiving such service to be designated in advance or for the institution of the service and resumption of the service to landing calls to require manual operation of a special switch other than a switch normally used by a passenger to select the floor of destination. In the latter case, the special switch is not normally available to anyone except a car attendant or certain designated persons, such as supervisors.

It is not uncommon for a person intending to perform an assault, such as a robber, to station himself at an unattended landing, such as a landing other than the lobby floor or landing, and to press the landing button in the expectation that an ascending or descending elevator car will carry a passenger or passengers upon whom the assault can be performed. This is particularly true late at night in apartments or after business hours in office buildings when landing calls above the lobby landing are relatively few. At such times, it is possible to give preference to calls registered by passengers in the car (car calls) without a substantial decrease in service to passengers at landings, but the service to such latter passengers should be resumed automatically and as soon as car calls are no longer registered. By causing an elevator car to first carry out delivery of a passenger in a car to the landing designated by such passenger, stopping of the car and opening of its doors at intervening landings where an assailant may be present is avoided.

It is an object of this invention to detect existence of a call, or calls, registered form within an elevator (car calls) and to automatically prevent, during existance of that call, or calls, any service by that car to calls registered by passengers at landings and to automatically restore service to such landings subsequent to delivery of the car passenger and cancellation of such calls registered within the car.

It is a further object of the invention to afford a passenger in an elevator the security of uninterrupted travel to his destination, during periods when traffic demand does not dictate use of the normal collective operation.

In the system of the invention, an elevator which normally "collects", or stops at, landing calls registered for its direction of travel is modified to forego such collective action while a car call exists. While such a car call is in registration, stopping for landing calls is prevented. The time period elected for the modification to be effective would normally be late evening and night hours, at which times traffic is anticipated to be intermittent and security for the passenger in the car outweighs any inconvenience to the intending passenger at a landing.

Figure 2:
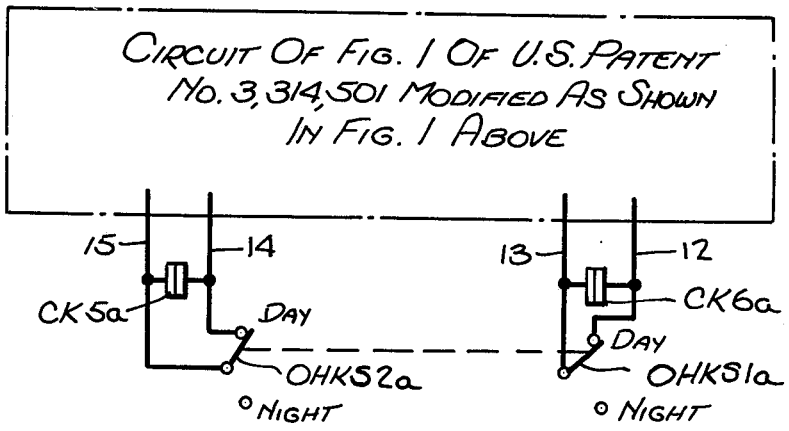

Other objects and advantages of the present invention will be apparent to those skilled in the art from the description of the preferred embodiments thereof, which description should be considered in conjunction with the accompanying drawing, in which:

FIG. 1 is a simplified, schematic wiring diagram illustrating the modification of certain circuits of the elevator control system illustrated and described in U.S. Pat. No. 3,314,501 required to provide the results of the invention; and FIG. 2 is similar to FIG. 1 and shows an alternate arrangement for providing the results of the invention.

It will be obvious to those skilled in the art that the control system of the invention may be used with various types of dispatching and control systems now used in the art including control systems for single elevator car installations. For purposes of simplification, the invention will be described by reference to, and operation in conjunction with, the system of control described in my U.S. Pat. No. 3,314,501. It will be understood, however, that the description of the invention in conjunction with the control system of said patent is merely for purposes of illustration.

In the description hereinafter given, it will be assumed that the elevator system comprises the circuits, controls, mechanisms, etc. set forth in said U.S. Pat. No. 3,314,501 modified as set forth hereinafter to include the circuits and controls of the present invention. Accordingly, the description of the operation of the system set forth in said U.S Pat. No. 3,314,501 will not be repeated herein, and the description and drawing will herein be limited to the modifications of the system set forth in said U.S. Pat. No. 3,314,501 required to adapt my present invention thereto and to certain portions of the system of said U.S. Pat No. 3,314,501 with which the modifications co-operate. For convenience, the symbols, diagram conventions, etc. employed in said U.S. Pat. No. 3,314,501, will be used herein.

Switches employed in the preferred embodiment disclosed in FIG. 1 and not shown in said U.S. Pat. No. 3,314,501 are as follows:

HCK*a* — Control modifying switching relay

OHKS*a* — Manually operable selection switch

In the embodiment shown in FIG. 2, switdh OHKS*a* is a double pole switch and contacts CK5*a* and CK6*a* have been added to switching relay CK*a* of U.S. Pat. No. 3,314,501.

A three car elevator group is given as a specific example in said U.S Pat. No. 3,314,501, and in the preferred embodiment described herein, it will be assumed that a three car elevator group is also involved. However, for the purpose of simplifying the disclosure, the operation of only the switches and circuits for a car *a* will be fully described, it being understood that, if desired, similar controls and circuits may be provided for cars *b* and *c* of the three car group. Of course, it will also be understood that the invention may be used in an installation having a single car, two cars or a number of cars greater than three, the invention being applied to the operation of any one or more cars.

Circuits and components shown in FIGS. 1 and 2, other than those identified hereinbefore as being added, are shown in FIG. 1, and described in the specification, of said U.S Pat. No. 3,314,501.

In the elevator system described in said U.S. Pat. No. 3,314,501, there are switches at each landing which are manually operable by intending passengers at the landings to register demands for service (landing calls). In addition, there are manually operable switches in each car corresponding to the landings which the car services to permit passengers in the car to register demands for service (car calls). Normally, each car is dispatched from a dispatching landing and during its trip in one direction, ascending or descending, the car responds to each call, both car and landing, registered for service in the direction established for the car movement. Thus, for example, if the car is dispatched from the lobby floor in the upward direction, it will stop and open its doors at each landing above the lobby landing corresponding to an operated switch in the car and at each landing at which there is an operated switch indicating a demand for service in the up direction. Similarly, a car travelling in the down direction will normally stop and open its doors at each landing corresponding to an operated switch in the car and at each landing at which there is an operated switch indicating a demand for service in the down direction. Also, when the sytem is operating under "high call reversal" conditions, a car will not reverse direction until it has reached the landing corresponding to the highest registered demand for service, either a car or a landing call.

From an examination of FIG. 1 and a comparison thereof with FIG. 1 of said U.S Pat. No. 3,314,501, it will be apparent that the circuit of said patent is modified as follows:

1. A manually operable switch OHKS*a* in series with the coil of a relay HCK*a* are connected in parallel with the coil of the relay CK*a* through leads 10 and 11, relay HCK*a* being energized when switch OHKS*a* is in its closed position, whenever there is a car call registered in car *a*. A lamp HCI*a* may be connected in parallel with the coil of HCK*a* and may be located in car *a* to indicate to the passenger therein that the system of the invention is in operation.

2. The connection between the coils of relays HJU*a* and HJD*a*, which are energized repectively by an up or down landing call above the position of car *a* for highest call determination, is completed through leads 12 and 13 by normally closed contacts HCK2*a* of relay HCK*a*.

3. The connection between contacts SGR7*a* and the coil of relay XS*a*, the latter normally being energized when there is a registered landing call to initiate stopping of car *a* for such a landing call, is completed through leads 14 and 15 by normally closed contacts HCK1*a* of relay HCK*a*.

Manually operable switch OHKS*a* preferably is actuable only by a key retained by authorized personnel and is located at a place convenient for such personnel, such as at the building lobby. However, if desired, switch OHKS*a* may be clock controlled so that it will be closed during predetermined periods of time, such as from 10:00 p.m. to 6:00 a.m.

When the switch OHKS*a* is open as shown in FIG. 1, the elevator system operates as described in said U.S. Pat. No. 3,314,501. However, when switch OHKS*a* is closed, relay HCK*a* is energized whenever a car call is registered in car *a*, and the contacts HCK1*a* and HCK2*a* are opened thereby preventing response of car *a* to landing calls and restricting response of the high call reversal circuit to effective car calls. Accordingly, car *a* will proceed from the landing at which the passenger entered car *a* to the landing corresponding to the car switch operated by the passenger in the car without stopping at landings other than said last-mentioned landing, even if a landing call switch is operated at such other landings.

Similarly, if more than one car call switch is operated, car *a* will continue to proceed to the corresponding landings until all car calls are satisfied and without stopping at landings other than those corresponding to the car calls, even if there are landing calls at such other landings.

When all of the car calls are serviced, relay HCK*a* is de-energized, and car *a* will then proceed to provide service to the registered landing calls in the manner described in said patent, except that when car *a* reaches a landing where there is a landing call and a passenger enters and operates a car call switch corresponding to a different landing, car *a* will proceed to such different landing without responding to landing calls at other landings.

Athough contacts HCK2*a* and their connections are not essential and may be omitted, and are not necessary in an elevator system not having high call reversal functions, the use of contacts HCK2*a* and their connections is desirable to prevent high call response to landing calls and thereby prevent undesirable movement of car *a* in the event that there is a registered landing call in the direction away from the destination of an entering passenger.

As mentioned hereinbefore, lamp HCI*a* may be connected as shown and placed where it is visible to car *a* passengers to alert them that the car calls have preferential status and thereby, to urge such passengers to expedite release of the car. However, lamp HCI*a* may be placed elsewhere or omitted.

The embodiment illustrated in FIG. 1 is preferred because the additional parts may be readily added to an existing elevator control system, and it is a simple matter to include lamp HCI*a*. However, if desired, the relay HCK*a* may be eliminated if the installed relay CK*a* has unused contacts or if the installation is an original installation and relay CK*a* is provided with a sufficient number of contacts. In the alternative embodiment in FIG. 2, a pair of normally closed contacts CK5*a* and CK6*a* are used in place of the contacts HCK1*a* and HCK2*a* shown in FIG. 1, and a double pole switch having the poles OHKS1*a* and OHKS2*a* is connected as shown in FIG. 2 to provide the operation of the invention described in connection with FIG. 1. As in the embodiment of FIG. 1, the contacts CK6*a* and the pole OHKS1*a* and their connections may be omitted if restriction of the high call reversal functions is not desired.

Although preferred embodiments of the present invention have been illustrated and described, it will be apparent to those skilled in the art that various modifications may be made without departing from the principles of the invention.

What is claimed is:

1. In an elevator system comprising at least one elevator car operating between a plurality of landings, said car having car call registering means therein for registering calls for service to said landings by a passenger therein, landing call registering means at a plurality of said landings for registering calls for service at said landings, normal control circuit means comprising car call responsive means controlled by said car call registering means for normally causing said car to stop at landings for which car calls are registered and landing call responsive means controlled by said landing call registering means for normally causing said car to stop at landings for which landing calls are registered, the combination therewith of control modifying means controllable by said car call registering means and connecting means for selectively connecting said control modifying means to said landing call responsive means for preventing response of the latter upon operation of said car call registering means.

2. An elevator system as set forth in claim 1, wherein said control modifying means comprises a relay responsive to said car call registering means, said relay having contacts, and said connecting means comprises a switch for connecting said contacts to and disconnecting said contacts from said landing call responsive means.

3. An elevator system as set forth in claim 1, wherein said control modifying means comprises a relay having contacts connected to said landing call responsive means and said connecting means comprises a switch for connecting said relay to and disconnecting said relay from said car call registering means.

4. An elevator system as set forth in claim 1, wherein said normal control circuit means comprises high call reversal means for causing said car to reverse its direction of movement at the highest registered call and wherein said connecting means also connects said control mofifying means to said high call reversal means for preventing response of the latter to landing calls upon operation of said car call registering means.

* * * * *